US005375525A

United States Patent [19]

Greenslade et al.

[11] Patent Number: 5,375,525

[45] Date of Patent: Dec. 27, 1994

[54] ORDNANCE TRANSFER INTERRUPTER

[75] Inventors: John T. Greenslade; Donald J. Behrens, both of Phoenix, Ariz.

[73] Assignee: Pacific Scientific, Chandler, Ariz.

[21] Appl. No.: 96,773

[22] Filed: Jul. 23, 1993

[51] Int. Cl.[5] ..... F42C 15/34; F42C 17/02; C06C 5/04

[52] U.S. Cl. ..... 102/254; 102/275.7; 102/275.12

[58] Field of Search ..... 102/256, 254, 255, 258, 102/260, 275.3–275.7, 275.12

[56] References Cited

U.S. PATENT DOCUMENTS

| | | | |
|---|---|---|---|
| H1266 | 12/1993 | Zacharin | 102/256 |
| 3,618,527 | 11/1971 | Kilmer | 102/254 |
| 3,728,936 | 4/1973 | Norris | 89/1.812 |
| 4,202,271 | 5/1980 | Day | 102/247 |
| 4,296,689 | 10/1981 | Hardesty | 102/260 |
| 4,483,250 | 11/1984 | Thurston et al. | 102/254 |
| 4,716,831 | 1/1988 | Bartholomew et al. | 102/275.3 |
| 4,771,694 | 9/1988 | Bartholomew et al. | 102/275.7 |
| 4,953,475 | 9/1990 | Monach et al. | 102/256 |
| 5,279,226 | 1/1994 | Ritchie et al. | 102/254 |

OTHER PUBLICATIONS

*Interruptor, SMDC Line*, Proposal No. D215, Apr. 30, 1992, from Pacific Scientific Energy Systems Division, submitted to EER Systems, Inc.

*Comet SMDC Interruptor: Revised Design*, Proposal No. F233, Jul 7, 1992, from Pacific Scientific Energy Systems Divisin, submitted to EER Systems, Inc.

*Primary Examiner*—David Brown

*Attorney, Agent, or Firm*—Knobbe, Martens, Olson & Bear

[57] ABSTRACT

An interrupter in a pyrotechnic system for selectively arming or disarming a detonation propagation transfer line comprises a mechanism for driving a barrier to and from safe and arm positions using safe and arm actuators. The motion of each of the actuators is damped to prevent cycling from external transient forces. A safety mechanism comprises a mediate member slaved to the drive mechanism and a lock member. A safing key is inserted into the interrupter to drive the lock member into a position which limits the motion of the mediate member whereupon an attempt to drive the barrier from a safe position will be blocked by the lock member. The safing key will be captured in the interrupter such that it cannot be removed until the barrier is returned to the safe position. In the preferred embodiment, the barrier comprises a rod having a non-circular transverse slot disposed between the line segments.

34 Claims, 8 Drawing Sheets

ORDNANCE TRANSFER INTERRUPTER

FIELD OF THE INVENTION

The present invention relates to a device for interrupting the transfer of an explosive charge, and more particularly to a safe and arm mechanism having an improved safety key.

BACKGROUND OF THE INVENTION

Missiles, aircraft, space systems and other vehicles commonly require multiple pyrotechnic devices, including destruct units, initiators, severance systems, actuators, etc. Due to the volatile nature of such pyrotechnic devices, most require safety features to prevent their inadvertent and hazardous initiation during maintenance of the vehicle prior to a mission. Such safety features are commonly known as safe and arm units, two of which are shown in U.S. Pat. No. 3,728,936 to Norris and U.S. Pat. No. 4,202,271 to Day.

Many pyrotechnic systems rely on what are generally known as linear explosive products or detonation transfer lines to communicate a signal from an explosion initiator to an output device on the vehicle. Such detonation transfer lines are used in place of electrically conductive wires, or the like, to ensure detonation of the pyrotechnic device in environments where large or fluctuating electromagnetic fields may render reliability of conductors suspect. The detonation transfer lines are typically thin-walled metal tubes with an optional outer braid, the tubes being packed with explosive material. These lines act as fuses in a sense, except they do not "burn" but rather detonate and propagate the percussive blast at a velocity of up to 7,000 meters per second. Two conventional detonation transfer lines are SMDC (Shielded Mild Detonating Cord) and FCDC (Flexible Confined Detonating Cord). These types of detonation transfer lines have a relatively mild concentration of explosive, such as RDX, along their length to prevent rupture of the enclosing tube.

It is vital to prevent the output device from being inadvertently initiated while ground personnel are working on the vehicle. In this respect, the safe and arm device prevents the initial explosion from propagating down the detonation transfer line from the initiator to the output device. Commonly, the safe and arm device utilizes a solenoid-driven barrier to physically block the explosive output from the initiator. In the armed mode, an air gap is typically formed by aligning a barrier aperture between the initiator output and the ordnance transfer line. With the barrier aperture aligned in this manner, the percussive force generated by the initiator propagates across the air gap to continue along the transfer line to the output device.

Due to the mild concentration of explosive material, the air gap must be quite small. Prior testing by others has indicated that detonation transfer lines can propagate across an open air gap of up to 5 inches, yet only a maximum of 0.25 inches reliably across confined gaps. This short propagation distance in confined air gaps has proved to be a detriment in the design process. While linear-actuated barriers and disc-like rotary barriers may be quite thin, and thus allow for very small air gaps, they require a substantial amount of space to operate, which is a drawback in compact vehicles such as missiles.

There are several drawbacks to conventional safe and arm devices. Primarily, it is less than desirable to manufacture, ship and install a safe and arm device containing an initiator or an internal explosive, due to the chance of inadvertent detonation. Additionally, there is typically one output device per initiator and associated safe and arm device. Combining two such devices into one is complex and can increase the cost substantially, especially in vehicles with multiple pyrotechnic systems. It is apparent there are drawbacks with present barrier-style safe and arm devices containing initiators.

A further feature desired by most customers for safe and arm security devices within pyrotechnic systems is a safety key which can lock the device in a safe position prior to the intended mission to ensure that output devices are not initiated. In the event an arm signal is sent while the particular device is in the locked safe mode, the safety key cannot then be withdrawn before an arm signal is removed.

In barrier-style safe and arm devices, the safety key serves to physically lock the barrier in a position closing the air gap leading to the transfer line. Prior mechanisms for preventing removal of the safety key in the event of an erroneous arm signal have made use of a separate solenoid-driven locking element or a relatively complex bolt or other locking arrangement. These mechanisms ultimately add weight and cost and reduce the reliability of the overall system.

The extreme shock, acceleration or vibratory motions imposed on vehicles in flight can inadvertently actuate mechanical devices such as barrier-type safe and arm devices. Just prior to a mission, the safety key is removed and the device then is capable of being armed, depending on remote signals from a control unit or operator. However, the internal mechanism for translating or rotating the barrier is typically biased in one position or the other without rigid physical impediments to motion, thus allowing the possibility of an unwanted position change due to external forces. Such an unwanted change from an arm to safe position, for example, is highly undesirable.

In short, there exists a need for a compact safe and arm device utilizing a safety key which overcomes the drawbacks of the prior art.

SUMMARY OF THE INVENTION

The present invention, in its preferred embodiment, provides an improved ordnance transfer interrupter having a barrier which can be driven between a safe position and an arm position, and a safety mechanism featuring a removable safing key which locks the barrier in the safe position and cannot be unlocked if the barrier is moved to an intermediate position between the safe and arm positions. The ordnance transfer interrupter comprises a housing, first and second ordnance line segments connected to the housing, a barrier interposed between the ordnance line segments, a driving mechanism for moving the barrier between a safe and an arm position.

The safety mechanism includes a mediate member which is slaved to move in response to movement of the barrier, and a safety lock member which is movable between a first position and a second position, the second position interfering with the movement of the mediate member during movement of the barrier from the safe position to the arm position. When the safety lock member is in its first position, the mediate member is free to move relative thereto and thus the barrier is free to move between the safe and arm positions. With the safety lock member in its second position, however, although the mediate member and cooperating barrier are restricted from movement into the arm position, the barrier may be driven to an intermediate position which causes the mediate member to interact with the safety lock member to impeded its movement. Preferably, the safety lock member is both translatable and rotatable and the interaction with the mediate member prevents such rotation and translation.

More succinctly, when the barrier is in the safe position and the safety lock member is in the second position, an errant signal may cause the driving mechanism to attempt to move the barrier to an arm position at which point it is driven to an intermediate position with the safety lock member interfering with further movement of the mediate member and coupled barrier. If such an errant arm signal is received, the safety lock member is prevented from moving out of the way of the mediate member until which time the barrier is once again returned to a safe position.

In the preferred embodiment, the safety mechanism also includes a safing key which translates and rotates within a channel from a first position to a second position, corresponding to the first and second positions of the safety lock member. In one embodiment, the safety key and safety lock member have interlocking portions which ensure their coupled movement between their respective first and second positions. The housing of the interrupter includes a seal against contamination of the internal mechanisms, the seal being in contact with the safety lock member in first position and in contact with the safing key in the second position.

In accordance with one embodiment of the ordnance transfer interrupter, a generally L-shaped keyway is formed in the channel receiving the safing key, the L-shaped keyway providing a relief into which a projection from the safing key translates. Also, the safety lock member comprises a push rod which is spring biased into the first position towards the safing key. Thus, by inserting the safing key into the L-shaped keyway against the bias of the spring, the projection on the key may be locked within an annular portion of the keyway. The safety lock member includes a lug which translates within a vertical channel within the interrupter housing in order to maintain a preselected orientation for the interlocking portions when the safety key is removed.

In a preferred arrangement, the mediate member comprises a rack having a thrust pin which extends within a cutout in the push rod. The push rod further comprises terminal portions at the ends of the cutout, one of which includes a notch sized to receive the thrust pin. The thrust pin is positioned on the rack so that it is disposed within the notch when the barrier is in the intermediate position and the safety lock member is in the second position. The notch is preferably closer to a first end of the push rod configured to receive the safing key.

In a further advantageous arrangement of the ordnance transfer interrupter of the present invention, the driving mechanism has at least one fluid damper connected thereto which limits the maximum rate of movement of the driving mechanism such that the time to move the barrier between the safe and arm positions is equal to or greater than a threshold time. The dampers may be fluid dampers comprising a piston within a closed chamber and an opening in the piston for drawing or expelling fluid through the opening in response to movement of the piston. Preferably, the fluid is air. Furthermore, the driving mechanism preferably comprises two actuators; one which drives the barrier from the safe position to the arm position, and another which drives the barrier in the reverse direction. The force for driving the actuators must be sufficiently great to overcome a biasing spring holding the barrier in the safe position.

In a still further preferred aspect of the present invention, the barrier is a rotary-type having a passageway and being positionable into first and second positions. The passageway extends between the ordnance transfer line segments in the first position to form an air gap connecting the first and second segments. In order to enhance detonation propagation across the air gap, the passageway has a non-circular cross section. The barrier blocks the transfer segments when the passageway is in the second position. In a specific configuration, the passageway has an oval cross section and a length which is at least $\frac{1}{4}''$ and is approximately $\frac{1}{2}''$. The barrier may be formed by a rod and the passageway by a slot oriented transverse to the longitudinal axis of the rod.

In a preferred operating method of the present ordnance transfer interrupter, the barrier is driven between a safe position and an arm position. A rotatable member is rotated and a translatable member is driven during the step of driving the barrier. A safety lock member is moved to a first position permitting movement of the translatable member through its entire range of linear motion. Moving the safety lock to a second position blocks the linear motion of the translatable member. Performing the steps of moving the safety lock member to either the first position or the second position when the barrier is in the safe position is possible in the preferred method. Furthermore, the step of moving the safety lock member to a second position is accomplished by using a safing key to linearly translate the safety lock member. In a still further step, the safing key can be used to rotate a safety lock member while a spring is used to bias the safety lock member from the second position to the first position.

Some further aspects of the preferred method of utilizing the interrupter of the present invention include inserting a safing key into a housing which contains the safety lock member and using the safety key to move the safety lock member. Additionally, the barrier may be driven to an intermediate position between the safe position and arm position while the safety lock member is in the second position. The translatable member and the safety lock member can be interacted such that the safing key is not removable from the housing while the barrier is in the intermediate position. The interaction between the translatable member and the safety lock member may be released and thus the spring can bias the barrier towards the safe position.

DESCRIPTION OF THE PREFERRED EMBODIMENTS

Figure 1:
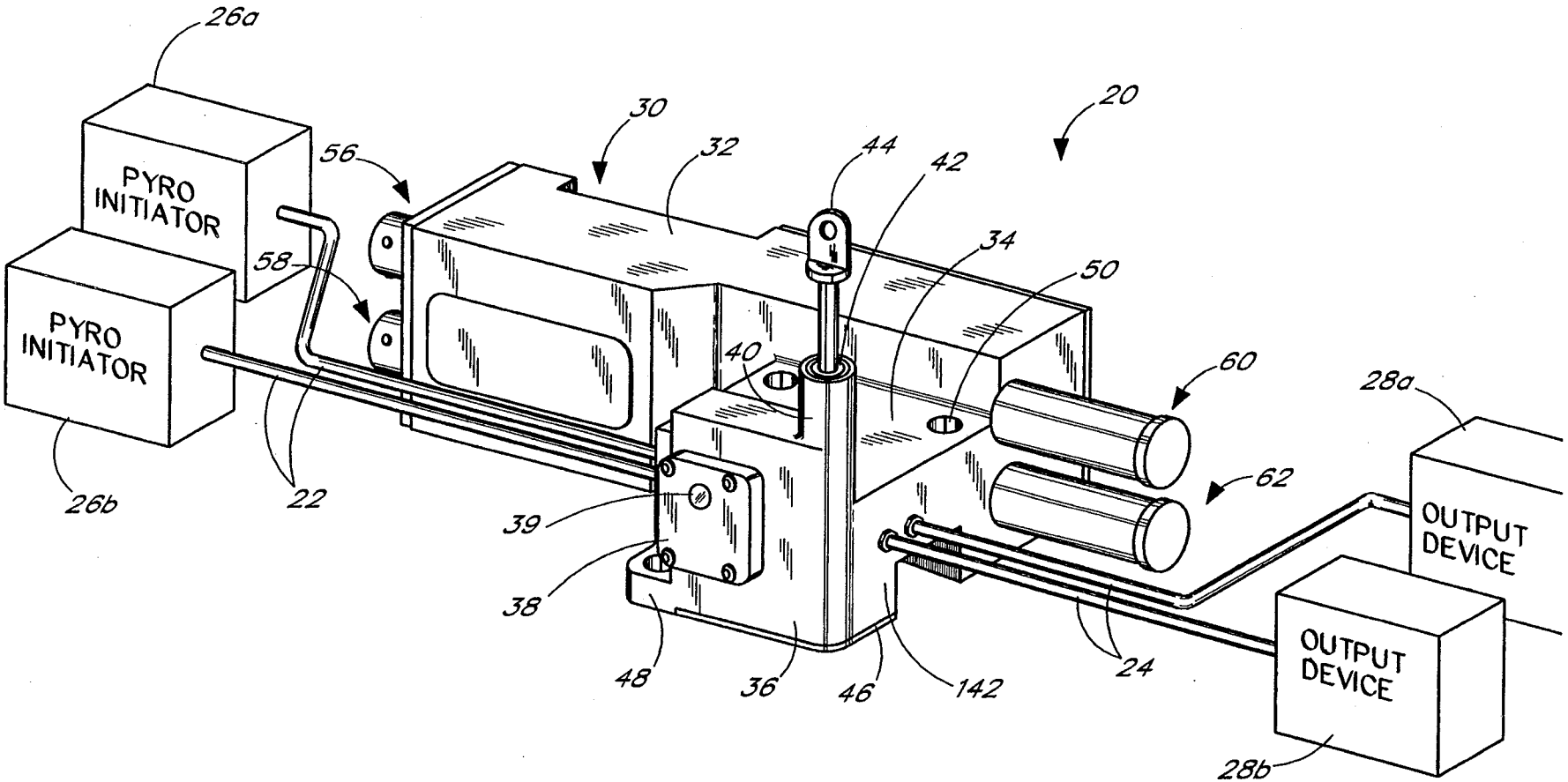
FIG. 1 is a perspective view of an interrupter according to the present invention shown schematically interposed in a detonation transfer line of a pyrotechnic system.

Referring to FIG. 1, an ordnance transfer interrupter 20 is shown interposed in two independent explosive trains between pairs of first and second ordnance transfer line segments 22, 24, respectively. In this context, a safe and arm unit for interrupting ordnance transfer in a mid-point of an ordnance transfer line will be referred to as an "interrupter." The first ordnance transfer line segments 22 are also connected to pyrotechnic initiators or detonators 26*a* and 26*b*, and the second ordnance transfer line segments 24 terminate at pyrotechnic output devices 28*a* and 28*b*. Two such pyrotechnic systems are shown yet the interrupter 20 may be interposed between one or more than two as well. The interrupter 20 is analogous to an electro-mechanical switch between the ordnance transfer line segments 22, 24. In this capacity, the interrupter 20 may selectively enable or disable the propagation of an explosive shock wave from one of the pyrotechnic detonators 26*a,b* as it advances through the first and second ordnance transfer line segments 22, 24 toward the connected pyrotechnic output device 28*a* or 28*b*. The output devices 28*a,b* may be one of a number of mechanisms requiring detonation, including destruct units, initiators, severance systems, actuators, etc. A plurality of such devices is typically used on vehicles such as spacecraft, aircraft, missiles and the like which may be subjected to extreme electromagnetic fields which render conventional ignition wires vulnerable.

The first and second ordnance transfer line segments 22, 24 are typically constructed of an outer braid surrounding a thin-walled metal tube within which a quantity of explosive is pre-packed. Such an explosive may be sold under the trade name RDX, for example. The ordnance transfer line segments 22, 24 are also known under the generic terms "linear explosive products" or "detonation transfer lines." Two commonly used ordnance transfer lines are sold under the acronyms SMDC, for Shielded Mild Detonating Cord, and FCDC, for Flexible Confined Detonating Cord. Once the pre-packed explosive is detonated in one end of the line, the percussive blast propagates at speeds of approximately 7,000 meters per second, and thus the lines essentially transfer a signal. In contrast, other ignitor devices act as fuses and utilize combustible materials which deflagrate or burn with high intensity to shoot flames toward the particular element being ignited.

Figure 2:
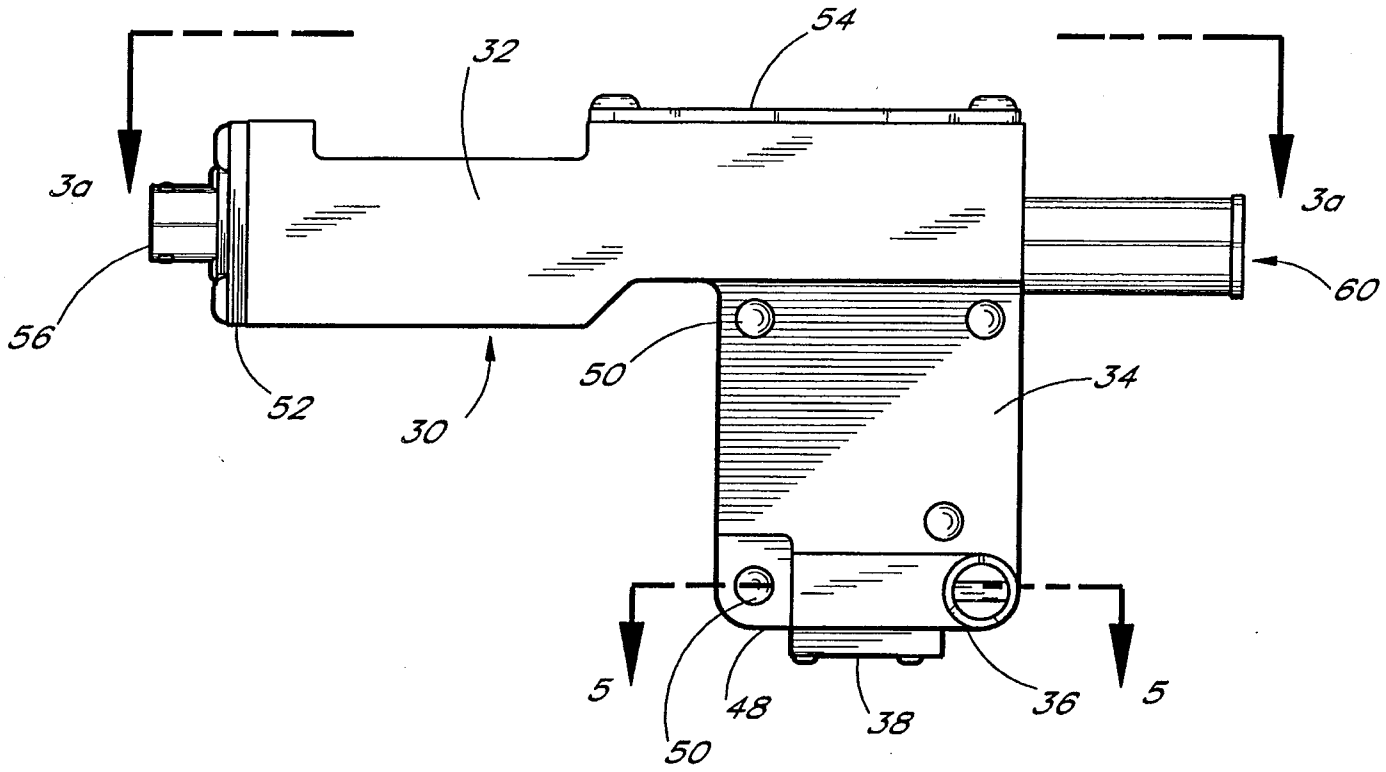
FIG. 2 is a top plan view of the interrupter.

Referring now to both FIGS. 1 and 2, the interrupter 20 comprises a generally L-shaped housing 30 having a main body portion 32 and a laterally extending portion 34. The housing 30 may be cast from aluminum with a number of ports and cavities machined therein to mount the functional elements of the interrupter 20. The laterally extending portion 34 projects forward from the main body 32 to terminate in a safety mechanism subhousing 36 having a front cover plate 38 attached thereto. A window 39 is mounted in the cover plate 38. A keyway extension tube 40 projects vertically upward from the safety mechanism subhousing 36 and defines the upper portion of a keyway channel 42 which receives a safing key 44. A lower cover plate 46 attaches to the bottom of the safety mechanism subhousing 36. A mounting flange 48 and several mounting holes 50 provide the structure for attaching the interrupter 20 rigidly to the frame of the host vehicle.

Referring now to FIGS. 1–3*b*, a drive mechanism for selectively enabling or disabling the ordnance transfer line will be described. The main body 32 of the housing 30 generally comprises a milled-out, rectangular-shaped member having cavities covered by an actuator cover plate 52 and a rear cover plate 54. The main body 32 is elongated with a pair of flanged electrical connectors 56, 58 mounted on the actuator cover plate 52 on the left end and a pair of fluid dampers 60, 62 mounted in ports on the right end, when viewed from the front, as in FIG. 1. The main body 32 is oriented so that a central vertical plane (not shown) forms a perpendicular angle with the laterally extending portion 34. The axes of the first and second dampers 60, 62 are in this central vertical plane.

Figure 3A:
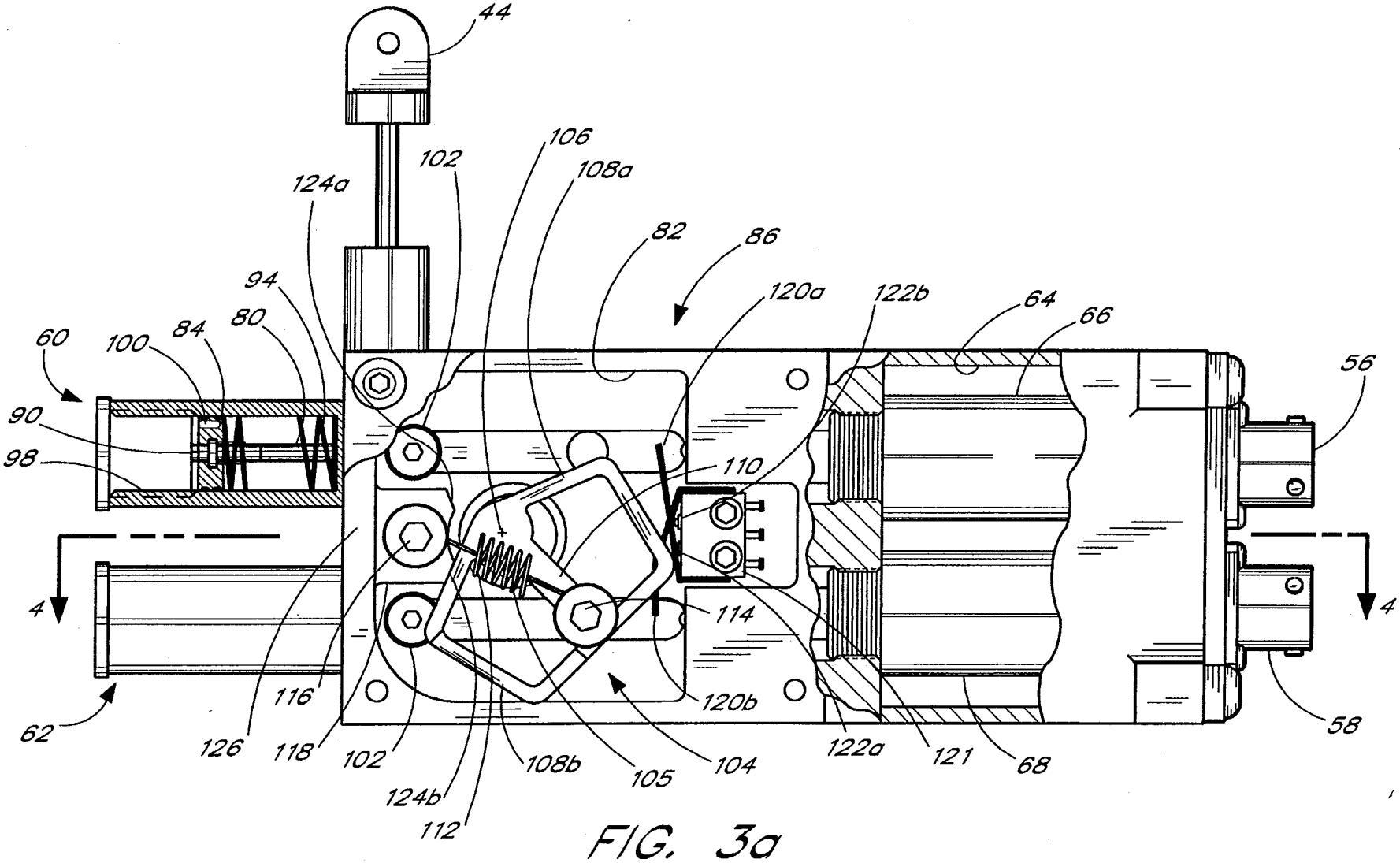
FIG. 3*a* is a partially cutaway rear elevational view of the interrupter taken along line 3*a*—3*a* of FIG. 2.
Figure 3B:
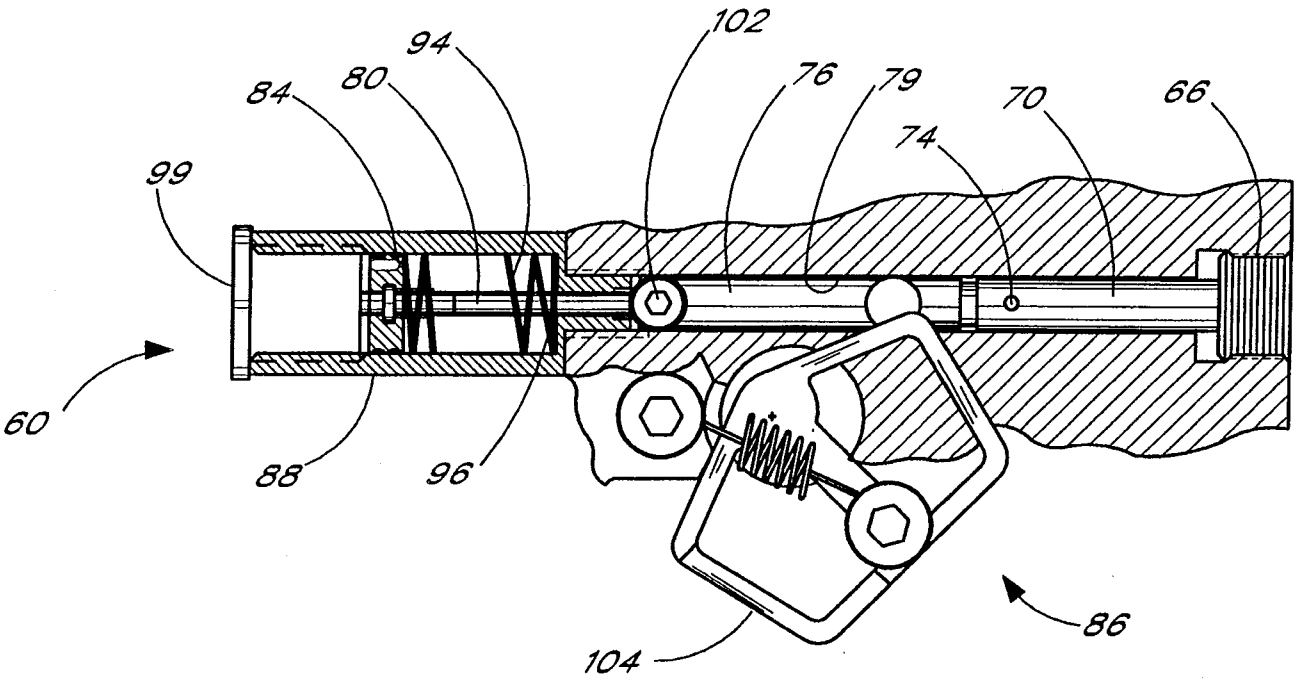
FIG. 3*b* is a cross-sectional view of an upper drive mechanism of the interrupter taken along line 3*b*—3*b* of FIG. 4.

Now with specific reference to FIGS. 3*a* and 3*b*, an actuator cavity 64 contains first and second linear actuators 66, 68. The actuators 66, 68 may be conventional solenoids requiring an input voltage of between 24 and 32 VDC, and preferably 28 VDC. Output shafts 70 of the actuators 66, 68 are coupled, such as with dowel pins 74, to pull rods 76 which are arranged to translate along their axes within a bore 79. The linear actuators 66, 68, output shafts 70 and pull rods 76 are shown herein as a preferred example of a prime mover of a drive mechanism 86. As will be described in greater detail below, linear motion is converted to rotary motion, and thus the preferred prime mover system shown may be replaced by a rotary prime mover, depending on the design considerations. However, it has been proven that the linear solenoids 66, 68 are a reliable and economical method of providing motion to the drive mechanism 86.

For reasons which will become apparent, the motion of each of the pull rods 76 is coupled to one of the aforementioned in-line fluid dampers 60, 62 (shown on the exterior of the housing 30 in FIG. 1). The right ends of each of the pull rods 76 are coupled via a pin or other means to piston rods 80 having piston heads 84 attached thereon. The damper housings 88 have an internal bore or chamber 98 capped with a plug 99 in which the piston heads 84 reciprocate. The piston heads 84 include internal retaining rings and O-ring seals 90 mounted within to provide a fluid-tight seal with the piston rods 80. Damper springs 94 act between a shoulder 96 in the damper housing 88 and the inward side of the piston heads 84 to bias the heads and connected piston rods 80 outward from the housing 30. The chamber 98 is divided into two portions linked by small openings 100 through which fluid may pass from one side of the piston head 84 to the other.

Linear motion of either of the pull rods 76 is thus impeded by virtue of their attachment to the piston heads 84 and the natural resistance to movement of the fluid passing from one side to the other through the opening 100. Such damped resistance to movement is generally proportional to the amount of force exerted on the piston heads 84, and in addition, a force is exerted by the damper spring 94 in compression, which is proportional to the amount of compression. Upon release of the actuation signal from either of the actuators 66, 68, the pull rods 76 and piston rods 80 are returned to a rest position by force of the damper spring 94 and also an optional internal spring in the actuators (not shown).

With reference to FIG. 3*a*, each of the pull rods 76 has a cam follower 102 mounted thereon extending into a rear cavity 82. The cam followers 102 project into a plane of motion of a bell crank 104 having a hub 105 which pivots about an axis 106 (shown in FIG. 4). The bell crank 104 includes upper and lower closed loops 108*a,b* extending outward from a central support bridge 110. The bell crank 104 is biased into a first or a second position by an over-center, bistable mechanism incorporating a spring 112. In this respect, the spring 112 is attached to a post 114 located on the left end, as seen from the front, of the central support bridge 110 of the bell crank 104, and at the other end to a post 116 mounted to a flange 118 of the housing 30. The rigid flange 118 includes angled stops 124 which contact each of the closed loops 108*a,b* to limit the angle of rotation of the bell crank 104 to 90 degrees. Due to the fact that the hub 105 of the bell crank 104 is located between the posts 114, 116, the longest the spring 112 may stretch is when the non-stationary post on the bell crank 104 is in line with the hub 105 and stationary post on the flange 118. Thus, the spring 112 biases the bell crank 104 in a clockwise or counterclockwise direction so that either the upper closed loop 108*a* or the lower closed loop 108*b* contacts one of the angled stops 124.

The cam followers 102 act on the closed loops 108*a,b* to rotate the bell crank 104 from one position to the other, past the top dead center unstable point of the bistable mechanism spring 112. More specifically, the actuators 66, 68 are preferably pull-type solenoids which are in the relaxed position with the cam followers 102 abutting the drive mechanism cavity right outer wall 126. Upon receipt of an electrical signal via leads (not shown) attached to one of the flanged connectors 56, 58, either of the actuators 66, 68 cause the cam followers 102 to translate and contact one of the closed loops 108*a,b* of the bell crank to rotate the bell crank against the action of the spring 112. The distance the cam followers 102 translate is preferably only far enough to rotate the bell crank 104 past the position of top dead center, at which point the spring 112 biases the bell crank into the opposite position against one of the stops 124.

With the bell crank 104 biased into a second position so that the lower closed loop 108*b* contacts a lower stop 124*b*, as shown in FIG. 3*a*, an actuator arm 120*a* mounted as a leaf spring on an electrical switch housing 121 is forced into contact with a switch plunger 122*a*. Conversely, with the bell crank 104 biased into a first position so that the upper closed loop 108*a* is in contact with the upper stop 124*a*, an actuator arm 120*b* is forced into contact with a second electrical switch plunger 122*b* on the switch housing 121. The lower closed loop 108*b* has a region stepped along the periphery of the bell crank 104 in order to contact the actuator arm 120*a* and bias it into contact with the switch plunger 122*a* at a spaced location from the switch plunger 122*b*. Switches in the switch housing 121 responsive to plungers 122*a,b* provide a remote monitoring indication for the position of the bell crank 104. Preferably, an interrogation signal via one of the flanged connectors 56, 58 sent through the switches determines which position the bell crank 104 is in and translates this information to a remote indicator.

Figure 4:
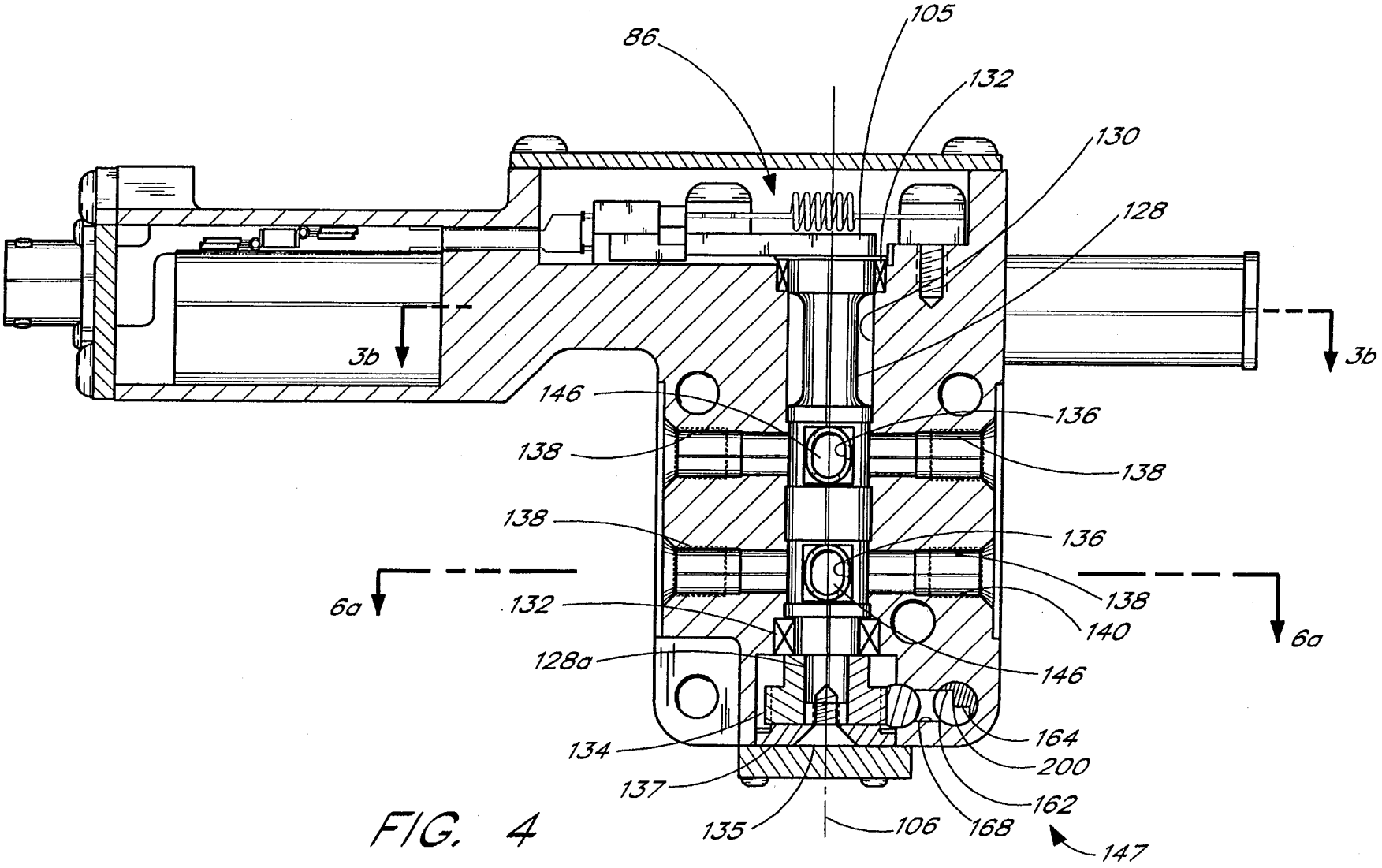
FIG. 4 is a cross-sectional view of the interrupter taken along line 4—4 of FIG. 3*a*.

With reference to FIG. 4, a rotor 128 is shown extending substantially the length of the laterally extending portion 34 of the housing 30. The rotor 128 is journaled within a cylindrical cavity 130 by bearings 132. The rotor 128 is substantially a rod-like element being permanently attached at the rear end to the bell crank hub 105. At the extreme front end of the rotor, a square extension 128*a* mates within an internal square aperture in a pinion 134, and the assembly of the rotor 128 and coupled pinion comprise a further portion of the drive mechanism 86. A screw 135 attaches a visual indicator plate 137 to the rotor 128 as well. The pinion 134 and visual indicator plate 137 are thus rotatable in response to the position of the bell crank 104.

A midportion of the rotor 128 includes a pair of slots or passageways 136 extending transversely through the rotor, these passageways rotating from a first position to a second position dependent on the bell crank 104 orientation. Therefore, it can be seen that the angular orientation of the pinion 134 and passageways 136 are also dependent on the movement of the linear actuators 66, 68 that act on the bell crank 104. Given that the bell crank 104 is biased into one of two positions due to the bistable action of the spring 112, these positions being 90 degrees apart, both the pinion 134 and passageways 136 also are aligned in one of two positions 90 degrees apart. In the view of FIG. 3, the bell crank 104 is in a second position which corresponds to an armed mode of the interrupter 20, as will be more clearly described below. The first linear actuator 66 thus comprises an "arm" prime mover of the drive mechanism 86 as it has the capacity for rotating the bell crank 104 into the armed mode. The other linear actuator 68 thus comprises a "safe" prime mover capable of rotating the bell crank 104 into the first or safe position.

Two pairs of detonation propagation ports or channels 138 extend transversely from the left and right sides of the laterally extending portion 34 of the housing into communication with the cylindrical cavity 130. The four channels 138 have their axes in a horizontal plane which intersects the rotational axis 106 of the rotor 128. Each pair of channels 138 is aligned and faces one another across the cylindrical cavity 130. Each of the channels 138 terminates in a female threaded receptacle 140 which receives a mounting connector 142 (seen in FIG. 1) from one of the detonation transfer line segments 24.

Figure 6B:
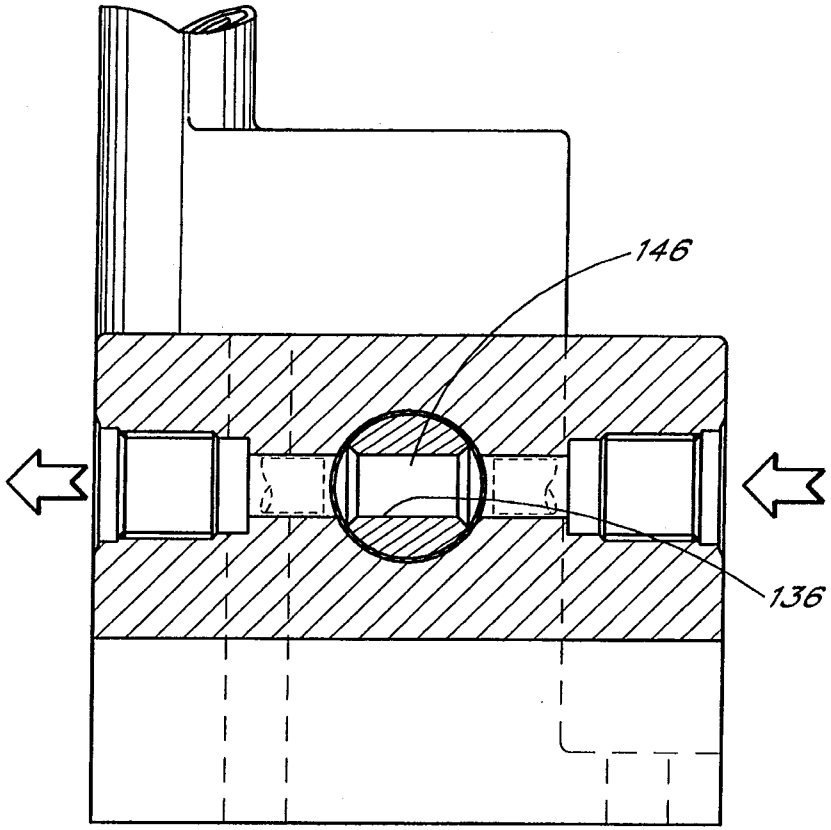
FIG. 6*b* is a cross-sectional view of a detonation propagation channel with the barrier in the armed mode.
Figure 6A:
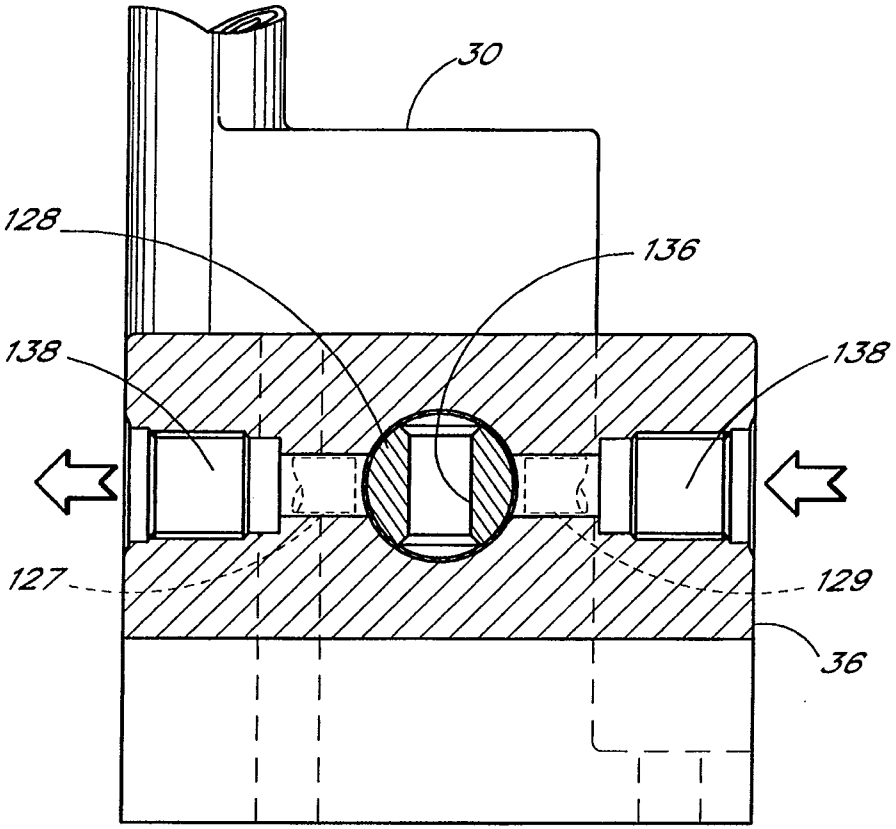
FIG. 6*a* is a cross-sectional view of a detonation propagation channel with the barrier in the safe mode.

The midportion of the rotor 128 provides a barrier to the propagation of an explosive charge from carrying across the cylindrical cavity 130, as seen in FIG. 6*a*. Alternatively, the two passageways 136 may be simultaneously aligned with the two pairs of channels 138 to provide a passive avenue or air gap 146 for the explosive charge to propagate across the cavity 130, as in FIG. 6*b*. At the end of each of the detonation transfer line segments 22, 24 there is preferably a detonation booster tip 127, 129. These booster tips 127, 129 provide donor and receptor elements to enhance the propagation of the explosion from one side of the cavity 130 to the other. Depending on the rotational orientation of the bell crank 104 with respect to the passageways 136, the passageways are either in alignment with the channels 138 or 90 degrees out of alignment with the channels when the bell crank 104 is in the safe position.

The air gap 146 formed when the passageways 136 are aligned with the channels 138 comprises a passive detonation propagation path. In this context, "passive" refers to the lack of any substance such as a pyrotechnic material which would aid or boost detonation propagation between the two segments 22, 24 of detonation transfer line.

In the embodiment shown in the FIG. 3, the bell crank 104 is in the armed position, with the lower closed loop 108*b* in contact with the lower stop 124*b*, when the passageways 136 are aligned with the channels 138, and thus detonation propagation is possible between transfer line segments 22, 24. Conversely, the bell crank 104 is in the safe position when the upper closed loop 108*a* is in contact with the upper stop 124*a*, and the passageways 136 are out of alignment with the channels 138, thereby forming a barrier between transfer line segments 22, 24. Once again, the bell crank 104 is rotated by contact with either of the cam followers 102 depending on whether the safe actuator 66 or arm actuator 68 receives an energizing pulse.

The rotor 128 has an outer diameter of approximately half an inch, which is the approximate size of the cylindrical cavity 130. This results in an air gap 146 formed between the facing booster tips also of half an inch. Previously, the maximum reliable air gap which was utilized was one-quarter inch. The present invention incorporates a novel shape of passageway which allows the length of the air gap 146 to be increased, and thus allows a rotary barrier to be used without packing a booster charge in the passageway 126. Preferably, the passageways 136 are formed with a non-circular cross section, as opposed to prior configurations. Such a non-circular cross section presents a non-axisymmetric boundary to the detonation shock wave across the air gap 146 which enhances the distance at which the explosion may be propagated reliably. More preferably, the passageways 136 have an oval cross section. Additionally, the length of the air gap may be greater than one-quarter an inch, and preferably the air gap has a length of approximately one-half an inch. The present embodiment of the passageways 136 has undergone vigorous Bruceton testing and proved to be reliable across the aforementioned size of air gap.

The present interrupter 20 includes a safety mechanism 147 which prevents the device from being switched from a disabled to an enabled mode without a specific sequence of operations. In conjunction with the above description of FIG. 6*a*, the pyrotechnic system is disabled, or in a safe mode, when the passageways 136 are oriented perpendicular to the axis of the detonation propagation channels 138. Conversely, as in FIG. 6*b*, the pyrotechnic system is enabled, or armed, when the passageways 136 are in line with the detonation propagation channels 138. Given that the angular orientation of the passageways 136 and rotor 128 are dependent on the bell crank 104 movement, the bell crank is biased into either a safe or an arm position corresponding to the above-described second and first positions, respectively.

Now, with reference to FIGS. 4 and 5*a–c*, the safety mechanism 147 is described in greater detail. The safety mechanism 147 generally comprises the pinion 134 which cooperates with a mediate member 148, a safety lock member 150, and the safing key 44. The mediate member 148 includes a linear series of gear teeth 152 comprising a rack which mates with the external gear teeth on the pinion 134. The main body 154 of the mediate member 148 translates vertically within a relatively closely fitting cavity 156. The safety lock member 150 comprises an elongated irregular element having an upper or first end 158 and a lower or second end 160. A pair of juxtaposed longitudinal cutouts 162, 164 are machined into the safety lock member 150 along a region between the first and second ends 158, 160. As seen in the cross section of FIG. 4, the cutouts 162, 164 form a step or sawtooth on the safety lock member 150. The mediate member 148 additionally comprises a thrust pin 166 which extends into one or the other cutout 162, 164, depending on the rotational orientation of the safety lock member 150. More particularly, the thrust pin 166 extends away from the main body 154 to translate in a slot 168, the slot being aligned with one or the other cutout 162, 164, as shown in FIG. 4.

Figure 5A:
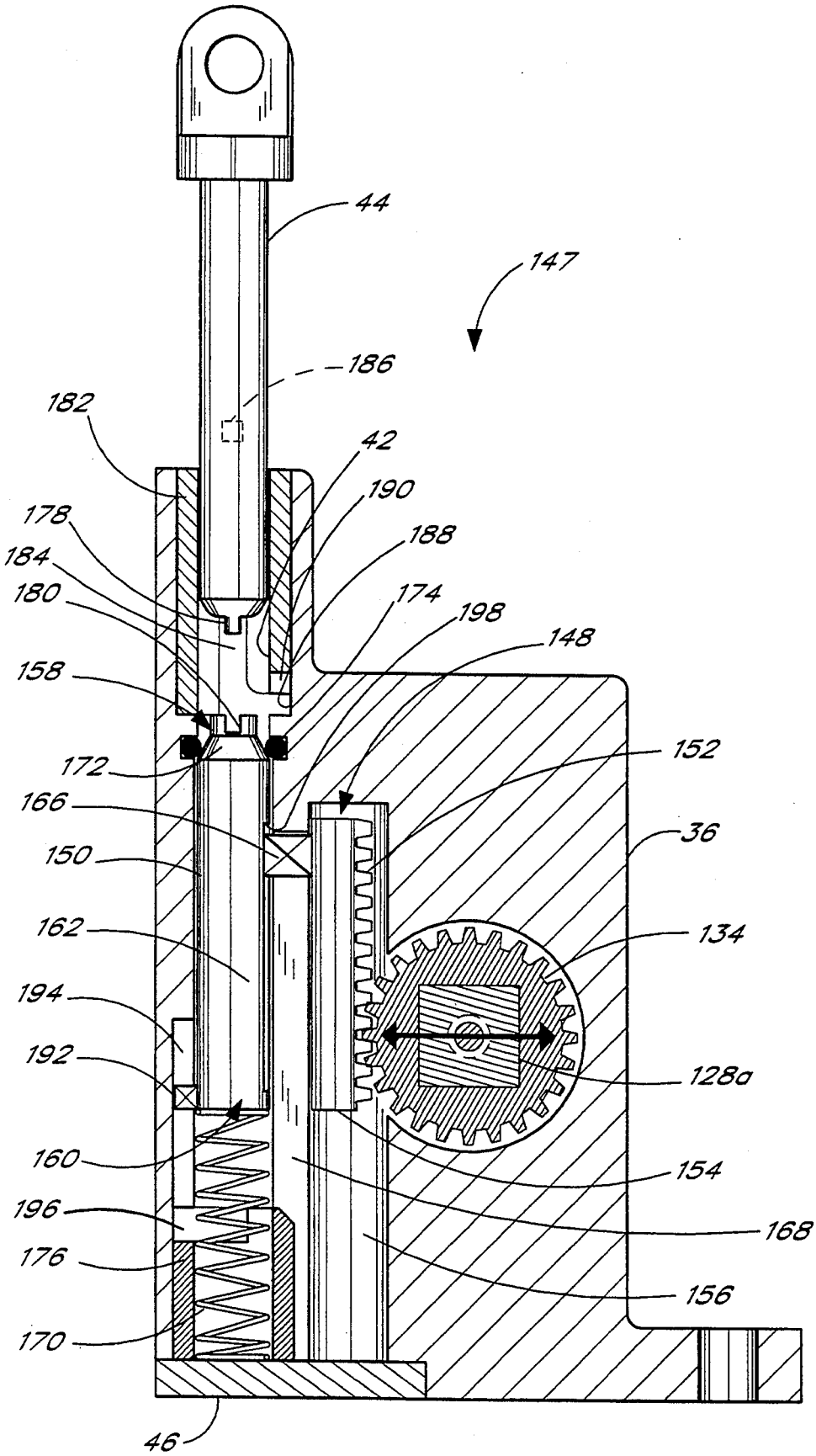
FIG. 5*a* is a cross-sectional view taken along line 5—5 of FIG. 2 of the safety lock mechanism of the present invention in the armed mode.
Figure 5C:
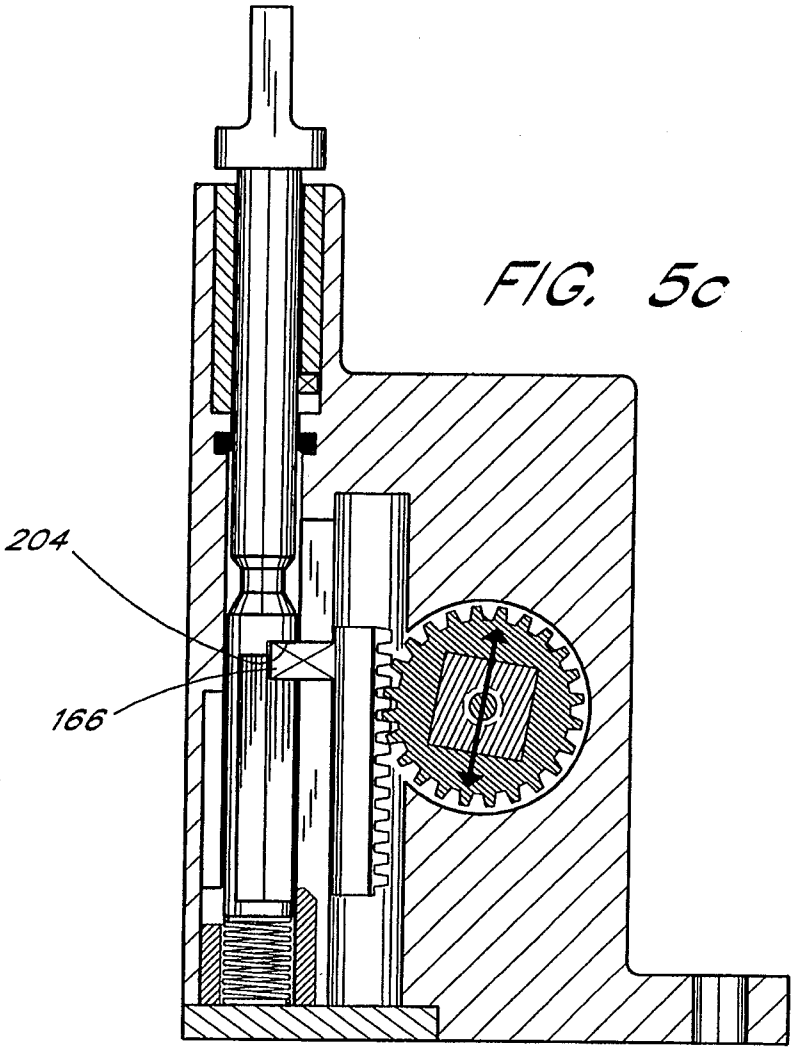
FIG. 5*c* is a cross-sectional view of the safety lock mechanism in an intermediate mode.
Figure 5B:
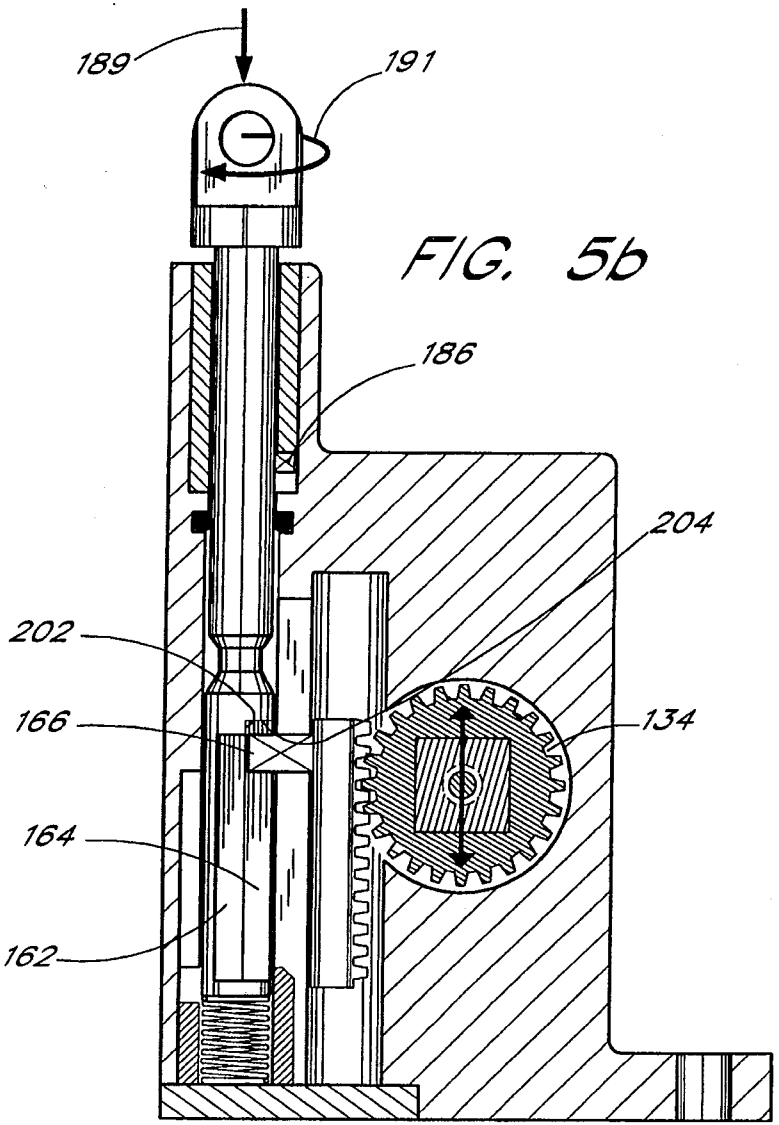
FIG. 5*b* is a cross-sectional view of the safety lock mechanism in the safe mode.

In order to describe the movement of the safety mechanism, FIGS. 5*a* and 5*b* show the mechanism in the arm and safe modes, respectively. In FIG. 5*a*, the safing key 44 is removed from the keyway channel 42, allowing a spring 170 to bias the safety lock member 150 upward into a first position so that an upper shoulder 172 comes into sealing contact with an O-ring 174. The spring 170 is constrained within a sleeve 176 retained in the safety mechanism subhousing 36 by the lower cover plate 46. In the armed mode, the safety lock member 150 being biased against the O-ring 174 prevents dust and dirt from entering the safety mechanism subhousing 36 via the keyway channel 42. In addition, with the safety lock member 150 in an upper or first position, the thrust pin 166 freely translates within the first cutout 162. Thus, the pinion 134 may rotate freely as the mediate member 148 has no constraints on movement in the range of travel provided by the coupled 90-degree rotation of the rotor 128. The rotor 128, and specifically the passageways 136, may thus be oriented so that the interrupter is in either the safe or the armed mode when the safety lock member 150 is biased in the first position (in FIG. 5*a*, the mediate member 148 is depicted in an upper position corresponding to the armed mode). The safing key 44 is typically removed and the safety lock member 150 biased into the first position during a mission. The controller of the linear actuators 66, 68, whether a human operator or a computer, may thus set the interrupter in either the safe or the armed mode without hindrance.

Now with reference to FIG. 5*b*, the safing key 44 is oriented to change the interrupter 20 from the armed mode to the safe mode. In order to better understand the interaction of the various elements, it is instructional to describe the movement of the safing key 44 and safety lock member 50 in conjunction. This is due to the fact that they have interlocking portions comprising a male projection 178 on the safing key and a female slot 180 on the safety lock member 150 which rotationally couple their movement. The safing key 44 translates within a safing key sleeve 182 which is held within the keyway extension tube 40 in an interference fit or by other rigid means. The safing key sleeve 182 has a vertical slot 184 machined therein for a lug or bayonet projection 186 on the shaft of the safing key 44 to translate within. At the lower portion of the safing key sleeve 182, a short annular groove 188 connects the vertical slot 184 with a short vertical locking cavity 190 to form a generally L-shaped keyway groove.

The safing key 44 thus inserts in the direction of arrow 189 within the keyway channel 42 defined by the safing key sleeve 182 and presses the safety lock member 150 against the biasing action of the spring 170 so that the bayonet projection 186 reaches the location of the annular groove 188. At this point, the safing key 44 may be rotated in the direction of arrow 191 so that the bayonet projection 186 travels along the annular groove 188 and into the locking cavity 190, wherein the spring 170 biases the safety lock member 150 and coupled safing key 44 upward so that the safing key is locked within the keyway channel 42. The safing key 44 is thus locked within the interrupter 20 until both downward and rotational forces are sequentially applied thereto to reverse the aforementioned locking sequence. Additionally, when inserted and locked in place, the safing key 44 sealingly contacts the O-ring 174 to prevents dust and dirt from entering the safety mechanism subhousing 36 via the keyway channel 42.

In concert with the translation and rotation of the safing key 44, the safety lock member 150 undergoes the exact same movement from the first position to a second position due to the interlocking portions 178, 180. An outwardly extending lug 192 on the safety lock member 150 translates vertically within a slot 194 formed in the housing 30 until an annular relief region 196 is reached corresponding to the moment when the bayonet projection 186 reaches the annular groove 188. The safing key 44 and safing lock member 150 can thus be rotated freely. Upon reversal of the locking sequence described above, the safety lock member 150 retains the proper orientation for the interlocking portions 178, 180 due to the alignment of the lug 192 in the slot 194. Thus, the coupled movement of the safing key 44 and safety lock member 150 is ensured.

With reference to FIGS. 5*a* and 5*b*, the interaction between the rotor 128 and the safety mechanism 147 will be described. In FIG. 5*a*, as described previously, the thrust pin 166 may translate vertically within a first cutout 162. Thus, the interrupter 20 may be in the armed position with the thrust pin 166 in an upper position, or in a safe mode with the thrust pin in a lower position, when the safing key 44 is not installed. Upon depression of the safety lock member 150 by insertion and depression of the safing key 44, the interrupter 20 is returned to the safe mode by virtue of a terminal upper ledge 198 of the first cutout 162 contacting the thrust pin 166 if the interrupter is in the armed mode. Such contact pushes the mediate member 148 downward, causing the coupled pinion 134 to rotate. This feature allows an on-site maintenance worker to set the interrupter 20 in a safe mode without having to reset the device using the safe linear actuator 66. In addition, the connection of the safety lock member 150 with the rotor 128 allows the rotor to be reset from a partially rotated or intermediate position between the safe and arm positions. Of course, if the interrupter 20 is already in the safe mode, with the thrust pin 166 at a lower position, this sequence of events will not occur.

At the full travel of the safing key 44, the safing key and safety lock member 150 are rotated and locked in a second position, as described above. The rotation of the safety lock member 150 causes the second cutout 162 to come into alignment with the slot 168 so that the thrust pin 166 now translates therein. As can be seen from the cross-sectional view of FIG. 4, the thrust pin 166 extends nearly to the center axis of the safety lock member with the cutouts 162, 164 having a corner 200 approximately located on this axis. Thus, the safety lock member 150 can be rotated without contacting the thrust pin 166. The second cutout 164 extends slightly further upward than the first cutout 162 to form a small radially extending stop surface 202. With the safing key 44 installed and locked in place, a terminal upper ledge 204 of the second cutout 164 provides a barrier to upward translation of the thrust pin 166.

Now referring to FIG. 5*c*, after an arm signal is sent to the interrupter 20 with the safing key 44 installed, the rotor 128 may rotate approximately 10 degrees before the mediate member 148 is stopped from further movement by the interaction of the thrust pin 166 with the upper ledge 204. Because the thrust pin 166 is now juxtaposed with the radially extending stop surface 202, the coupled safing key 144 and safety lock member 150 cannot be rotated without the thrust pin retracting downward. This interaction between the thrust pin 166 and second cutout 164 thus accomplishes two objectives: prevents the interrupter 20 from being armed with the safing key 44 installed and prevents the safing key from being removed prior to the retraction of the thrust pin 166.

The thrust pin 166 may be retracted upon action of the bistable spring 112 pulling the bell crank 104 back to the safe position after the termination of the arm signal to the linear actuator 68, at which time the safing key 44 can be removed. Desirably, the duration of pulse to the actuators 66, 68 is on the order of hundreds of milliseconds, and preferably is between 240 ms and 500 ms. As a consequence, the interrupter 20 has returned to the safe mode because of the spring 112, even though the last signal sent was an arm signal.

The interrupter 20 of the present invention provides both a visual and a remote status check of the position of the rotor 128. Preferably, the visual indicator plate 137, which is coupled to the rotor 128, has large S and A characters inscribed on the outer surface facing the front of the interrupter 20 which are visible through the window 39 (FIG. 1). In the safe mode, the large S appears at the top of the visual indicator plate 137, and conversely, the large A is at the top in the armed mode. Additionally, the actuation of the switch plungers 122*a,b* by the actuator arms 120*a,b* provides an indication of the position of the bell crank 104 which can be determined by transmitting an interrogation signal to the switches in the switch housing 121.

Advantageously, the present interrupter 20 incorporates the dampers 60, 62 which substantially eliminate the possibility of cycling of the interrupter 20 from a safe to an armed mode, or vice versa, as a result of transient shocks incident on the host vehicle, or from other causes. Such shocks occur from sudden launch or flight acceleration, deceleration or external impacts, and typically last only milliseconds. Due to the dampers 60, 62 delaying the time period required to pull the piston heads 84 along the chambers 98, any transient shocks will disappear prior to the sufficient movement of the pull rods 76, 78 to reach a position of top dead center of the spring 112. However, the aforementioned duration of signal pulse to the linear actuators 66, 68, on the order of hundreds of milliseconds, is sufficient to pull the piston heads 84 along the chamber 98 against the resistance of the inner fluid. Stated another way, the dampers 60, 62 limit the rate of movement of the drive mechanism 86 at or below a predetermined value which precludes transient forces of less duration than a minimum threshold actuator pulse from cycling the interrupter 20. Moreover, such motion from vibration or shock may be induced due to the inherent inertia of the bell crank or associated moving parts. Therefore, the bell crank is designed with a unique shape to minimize the inherent inertia while providing sufficient structural rigidity to withstand the stresses imposed by the cam followers 102 and rigid stops 124. The dampers 60, 62 may be filled with a fluid or a gas, but are preferably pneumatic.

Furthermore, the description of certain elements of the present interrupter 20 is not considered to be limited to the specific rotary barrier type shown herein. For instance, the introduction of dampers to prevent inadvertent cycling of the drive mechanism may be incorporated into drive mechanisms which act on linear barriers. Likewise, the improved safety lock mechanism described can be incorporated into other types of interrupters, the novel aspects remaining unchanged. Moreover, the structural elements within the safety mechanism are shown and described as preferred embodiments only, and other configurations are possible. For instance, the preferred physical coupling of the linear motion of the safety lock member 150 and the rotational motion of the rotor 128 may be replaced with one or more intermediate elements which are responsive to one or both of these motions. Such intermediate elements may be electrically actuated, such as solenoids or small electric motors. Indeed, the preferred safing key 44 may even be replaced with a key having primarily rotational motion, such as conventional door keys, without deviating from the novel aspects of the safety mechanism.

In summary, although this invention has been described in terms of certain preferred embodiments, other embodiments that are apparent to those of ordinary skill in the art are also within the scope of this invention. Accordingly, the scope of the invention is intended to be defined only by the claims.

We claim:

1. An ordnance transfer interrupter, comprising:

a housing having a movable barrier therein, said housing connectable to first and second ordnance line segments with said barrier between said segments;

a driving mechanism which drives said barrier between a safe position and an arm position, said barrier having an intermediate position between said safe and arm positions; and a safety mechanism, comprising:

a mediate member, slaved to move in response to movement of said barrier;

a safety lock member which is translatable and rotatable between a first position and a second position when said barrier is in said safe position, said safety lock member being configured so that (i) the second position interferes with movement of said mediate member during movement of said barrier from the safe position towards the arm position, and (ii) the first position avoids such interference, said safety lock member having an interacting portion that interacts with said mediate member when said barrier is driven to said intermediate position with said safety lock member in said second position, said interaction of said interacting portion with said mediate member constraining said safety lock member, so that said safety lock member cannot move to said first position until said barrier is returned to the safe position.

2. The interrupter of claim 1, wherein said safety lock member comprises a push rod and wherein said safety mechanism additionally comprises a spring positioned to bias said push rod to said first position.

3. The interrupter of claim 2, wherein said mediate member comprises a rack having a thrust pin, and wherein said push rod comprises a cut out into which said thrust pin extends.

4. The interrupter of claim 3, wherein said push rod comprises terminal portions at ends of said cut out, one of said terminal portions having said interacting portion, said interacting portion comprising a notch sized to receive said thrust pin, said thrust pin positioned on said rack so that said thrust pin is disposed within said notch when said barrier is in said intermediate position and said safety lock member is in said second position.

5. The interrupter of claim 4, wherein the push rod has a first end configured to receive a safing key, and a second end configured to receive the force of a biasing spring, said notch being closer to said first end than said second end.

6. The interrupter of claim 1, wherein said safety mechanism additionally comprises a safing key, said housing having a channel for receiving said safing key, said channel being oriented and said key being configured to permit the key to translate and rotate the safety lock member from said first position to said second position.

7. The interrupter of claim 6, wherein said housing includes a seal which is positioned to (i) seal said safety lock member to said housing when said safety lock member is in the first position, and (ii) seal said safing key to said housing when said safety lock member is in the second position.

8. The interrupter of claim 6, wherein said housing includes a generally L-shaped keyway having a portion which extends longitudinally along said channel and an annular portion in the periphery of said channel, said key having a projection which is sized to be received within said keyway.

9. The interrupter of claim 8, wherein said key and said safety lock members have respective interlock portions, which require a predetermined orientation to mate with each other, said keyway being positioned within said channel to provide said predetermined orientation, whereby said interlock portions mate upon insertion of said key into said housing.

10. The interrupter of claim 9, wherein said safety lock member includes means for maintaining a preselected orientation for said interlock portion when said safety lock member is in said first position.

11. A method operating an ordnance transfer interrupter, comprising:

(a) driving a barrier between a safe position and an arm position;

(b) rotating a rotatable member through a range of motion during said driving step;

(c) driving a translatable member through a range of substantially linear motion during said rotating step;

(d) moving a safety lock member to a first position which permits movement of said translatable member through substantially the entire range of linear motion;

(e) moving said safety lock member to a second position which blocks said linear motion and prevents said translatable member from moving through a substantial portion of the range of linear motion; and (f) performing steps (d) and (e) when said barrier is in the safe position.

12. The method of claim 11, wherein said moving step (e) comprises using a safing key to linearly translate said safety lock member.

13. The method of claim 11, wherein said moving step (e) comprises using a safing key to rotate said safety lock member.

14. The method of claim 11, wherein the moving step (d) comprises using a spring to bias the safety lock member from the second position to the first position.

15. The method of claim 11, wherein the moving step (e) comprises inserting a safing key into a housing which contains the safety lock member, and using the safing key to move said safety lock member, said method additionally comprising (i) driving said barrier to an intermediate position between the safe position and the arm position when the safety lock member is in the second position, and (ii) interacting the translatable member and the safety lock member such that said safing key is not removable from the housing while the barrier is in the intermediate position.

16. The method of claim 15, additionally comprising the step of (i) releasing the interaction between the translatable member and the safety lock member, and (ii) spring biasing the barrier towards the safe position.

17. An ordnance transfer interrupter, comprising:

a barrier for interrupting ordnance transfer between two ordnance line segments;

a driving mechanism mechanically coupled to drive said barrier between a safe position and an arm position;

at least one damper connected to said driving mechanism, said damper having a damping characteristic which increases the amount of damping as the driving force on the barrier is increased, whereby the rate of movement of said driving mechanism is substantially equal to or less than a maximum rate and the time required to move said barrier between said positions is substantially equal to or greater than a pre-established threshold time.

18. The interrupter of claim 17, wherein said driving mechanism comprises a first actuator which drives said barrier from said safe position to said arm position, and a second actuator which drives said barrier from said arm position to said safe position.

19. The interrupter of claim 17, wherein said barrier is spring biased to said safe position, and wherein said force provided by said driving mechanism is sufficiently great to overcome said biasing force to move said barrier.

20. The interrupter of claim 17, wherein said damper comprises a fluid damper.

21. The interrupter of claim 20, wherein said fluid damper comprises a piston within a chamber and an opening in said piston for drawing or expelling fluid through said opening in response to movement of said piston.

22. The interrupter of claim 21, wherein said fluid comprises air.

23. An apparatus for interrupting ordnance transfer between first and second detonation propagation line segments, said apparatus comprising:

a rotary barrier between said first and second segments, said barrier including a passageway having first and second positions, said passageway extending between said segments in said second position such that the passageway forms an air gap which extends from an end of the first segment to an end of the second segment, said passageway having a non-circular cross section configured to enhance detonation propagation across said air gap between said ends, said barrier blocking detonation propagation between said segments when said passageway is in said first position.

24. The apparatus of claim 23, wherein said passageway has an oval cross section.

25. The apparatus of claim 23, wherein said rotary barrier comprises a rod and said passageway comprises a slot oriented transverse to the longitudinal axis of the rod.

26. The apparatus of claim 23, wherein said passageway has a length that is substantially greater than ¼ inch.

27. The apparatus of claim 26, wherein said length is approximately ½ inch.

28. An apparatus comprising:

first and second detonation propagation line segments, each of said segments comprising ordnance selected from the group of linear products which comprise shielded mild detonating cord 9SMDC) and flexible confined detonating cord (FCDC); and a rotary barrier between said first and second segments, said barrier including a passageway having first and second positions, said passageway extending between said segments in said second position such that the passageway forms an air gap which extends from an end of the first segment to an end of the second segment, said passageway having a non-circular cross section configured to enhance detonation propagation across said air gap between said ends, said barrier blocking detonation propagation between said segments when said passageway is in said first position.

29. An ordnance transfer interrupter, comprising:

a housing having ports for connecting said interrupter between first and second detonation propagation line segments; and a rotary barrier in said housing between said first and second segments, said barrier including a passageway having first and second positions, said passageway extending between said segments in said first position and forming a passive detonation propagation path which extends from an end of the first segment to an end of the second segment, said barrier blocking detonation propagation between said segments when said passageway is in said second position.

30. The interrupter of claim 29, wherein said passageway has an oval cross section.

31. The interrupter of claim 29, wherein said passageway has a length that is substantially greater than ¼ inch.

32. The interrupter of claim 29, wherein said rotary barrier comprises a rod and said passageway comprises a slot oriented transverse to the longitudinal axis of the rod.

33. The interrupter of claim 29, wherein said housing has ports for connecting said interrupter between third and fourth detonation propagation line segments; and wherein said rotary barrier is between said third and fourth segments, said barrier including a second passageway having first and second positions, said second passageway extending between said third and fourth segments in its first position and forming a passive detonation propagation path which extends from an end of the third segment to an end of the fourth segment, said barrier blocking detonation propagation between said third and fourth segments when said second passageway is in its second position.

34. An ordnance transfer interrupter comprising:

first and second detonation propagation line segments, each of said segments comprising ordnance selected from the group of linear products which comprise shielded mild detonating cord (SMDC) and flexible confined detonating cord (FCDC);

a housing having ports for connecting said interrupter between said first and second detonation propagation line segments; and a rotary barrier in said housing between said first and second segments, said barrier including a passageway having first and second positions, said passageway extending between said segments in said first position and forming a passive detonation propagation path which extends from an end of the first segment to an end of the second segment, said barrier blocking detonation propagation between said segments when said passageway is in said second position.

* * * * *

UNITED STATES PATENT AND TRADEMARK OFFICE

CERTIFICATE OF CORRECTION

PATENT NO. : 5,375,525

DATED : December 27, 1994

INVENTOR(S) : John T. Greenslade, et al

It is certified that error appears in the above-indentified patent and that said Letters Patent is hereby corrected as shown below:

Column 16, line 25, change "9SMDC)" to --(SMDC)--

Signed and Sealed this

Sixth Day of June, 1995

Bruce Lehman

*Attest:*

BRUCE LEHMAN

*Attesting Officer*

*Commissioner of Patents and Trademarks*